United States Patent [19]

Turley

[11] 4,022,040

[45] May 10, 1977

[54] METHOD OF OPERATION AND CONTROL OF CROWN ADJUSTMENT SYSTEM DRIVES ON CLUSTER MILLS

[75] Inventor: John W. Turley, Oxford, Conn.

[73] Assignee: T. Sendzimir, Inc., Waterbury, Conn.

[22] Filed: Sept. 25, 1975

[21] Appl. No.: 616,582

[52] U.S. Cl. ..... 72/10; 72/243; 72/248

[51] Int. Cl.[2] ..... B21B 31/26; B21B 37/00

[58] Field of Search ..... 72/240, 247, 248, 10, 72/12, 17, 243, 237, 241, 242

[56] References Cited

UNITED STATES PATENTS

| | | | |
|---|---|---|---|
| 2,100,653 | 11/1937 | Umansky | 72/250 X |
| 2,194,212 | 3/1940 | Sendzimir | 72/242 X |
| 2,526,475 | 10/1950 | Glesmann | 72/247 |
| 3,478,559 | 11/1969 | Polakowski | 72/242 |
| 3,587,263 | 6/1971 | McCarthy | 72/8 |
| 3,921,425 | 11/1975 | Sendzimir | 72/10 X |

*Primary Examiner*—Milton S. Mehr
*Attorney, Agent, or Firm*—Melville, Strasser, Foster & Hoffman

[57] ABSTRACT

In a cluster mill having individual crown adjustment drives to each saddle on at least one backing shaft to adjust the roll gap in line with each saddle, means to synchronize the drives mechanically to produce a tapered roll gap so that strip having a transverse taper in thickness can be rolled. Also means to control automatically the operation of the synchronized drives in response to the behavior of the rolled strip. Also means to synchronize the drives mechanically to produce a roll gap having a parabolic profile or any required profile to suit the incoming strip or to compensate for the crown of the mill itself.

5 Claims, 8 Drawing Figures

METHOD OF OPERATION AND CONTROL OF CROWN ADJUSTMENT SYSTEM DRIVES ON CLUSTER MILLS

BRIEF SUMMARY OF THE INVENTION

This invention relates to cold rolling cluster mills of the general type shown in Sendzimir U.S. Pat. Nos. 2,169,711; 2,187,250; 2,194,212 and 2,776,586.

The object of this invention is to provide improvements in the construction of such mills, with the objective of increasing the ability of these mills to roll strip which has a transverse taper in its thickness, or a transverse section of the same form as a section through a frustum of a wedge.

In the cold rolling of narrow gauge strip it is generally economically desirable to purchase coils of steel which have been hot rolled at a larger width, and subsequently slit to produce two or more coils of a narrower width suitable for cold rolling.

However, as is well known by those practiced in the art, it is normally necessary to hot roll strip with the center thickness greater than the edge thickness, in order to form a good coil of hot strip. When such coils are subsequently unwound, the strip slit down the center-line, and rewound, two coils are formed, each having a tapered cross section.

In order to cold roll such coils satisfactorily, it is necessary to form a tapered roll gap, with the objective of producing uniform elongation across the width of the strip.

With conventional two high and four high mills, there is no difficulty in producing a tapered roll gap, because there are independent front and rear screwdowns. In the case of Sendzimir cluster mills as described in the aforesaid Letters Patent, however, the front and rear screwdown drives operate in synchronism with each other, and so cannot be used to produce a tapered roll gap.

In the specification of U.S. Pat. No. 2,194,212, means of adjusting the contour of the rolls (and hence of the roll gap) are disclosed. Such means are incorporated in most modern Sendzimir cluster mills and embody individual drives (so called crown adjustment drives) to each shaft support (saddle) on at least one backing shaft to adjust the position of the shaft at the saddle in a sense to increase or decrease the roll gap in line with the saddle. As there may be from four to eight saddles, or even more, depending on the width of the mill, it is possible to achieve a very fine control of the profile of the roll gap.

Clearly it is theoretically possible by this means to set a roll gap having a tapered profile. However, in practice this is found to be impossible, because the operator needs to adjust from four to eight drives (depending on the number of saddles) simultaneously and all at different speeds.

The present invention comprises means to operate and synchronize the several crown adjustment drives on Sendzimir cluster mills to that the operator can conveniently use these drives to set a roll gap having a tapered profile, in order to roll successfully strip having tapered cross section.

Also the invention comprises means to control automatically the operation of the synchronized taper drives in response to the behavior of the rolled strip.

The invention also comprises means to operate and synchronize the crown adjustment drives to produce a roll gap having a parabolic or any required profile to suit the incoming strip or to compensate for the crown of the mill itself.

BRIEF DESCRIPTION OF THE SEVERAL VIEWS OF THE DRAWING

In FIGS. 1, 4, and 5, housings, bearings and seals are omitted for clarity.

DETAILED DESCRIPTION

Figure 1:
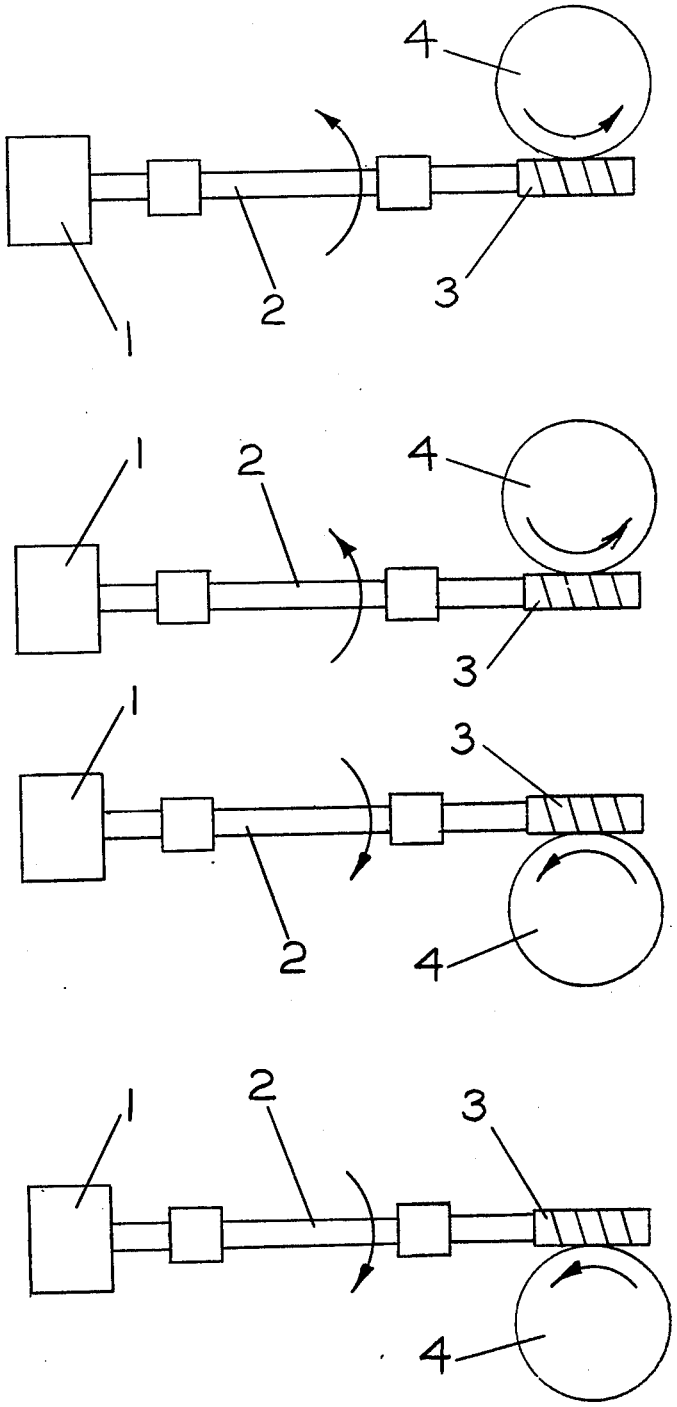
FIG. 1 PRIOR ART
FIG. 1 is a diagrammatic plan view of a typical crown adjustment drive system according to the prior art.

The purpose of FIG. 1 is to show the prior art and so clarify the description of the present invention.

In FIG. 1, which is drawn for a cluster mill having four saddles on each backing shaft, four identical hydraulic motors 1 drive four identical worms 3 through spindles 2. Four identical wormwheels 4 (one for each saddle location) are each provided with a bore in which an internal screw thread is cut. As each wormwheel 4 is rotated by its drive from motor 1 through spindle 2 and worm 3, a roll gap change is effected in line with the saddle corresponding to said wormwheel, said roll gap being proportional to the angular rotation of said wormwheel.

The method of converting rotation of said wormwheel to said roll gap (via threaded rod, rack, saddle pinions & eccentric ring, and rolls) is also established prior art and will not be considered here as it is of no relevance to the following description of the invention.

Figure 2:
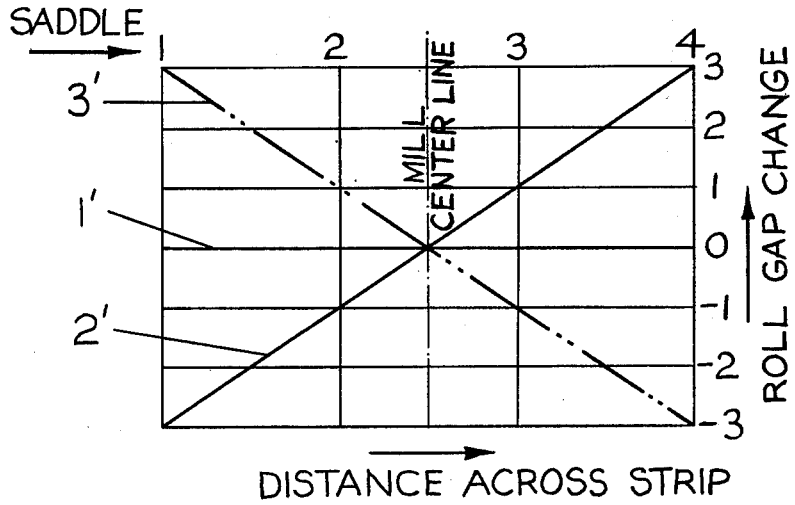
FIG. 2 is a diagram showing the roll gap change and therefore the required position relationships for each crown adjusting drive to be achieved when the taper drive is operating, for a mill having four saddles on each backing shaft.

In order to achieve a tapered roll gap, it is necessary to rotate the four wormwheels with a fixed relationship to one another, which is shown in FIG. 2. In FIG. 2, the abscissae are distances across the strip measured to each side from the center line of the mill, and the ordinates represent roll gap change from the initial condition. If the roll gap is initially parallel (curve 1′) and the angular displacements of the four wormwheels are considered to be zero at this time, then the angular displacements at the four saddles required to achieve a linear taper at the roll gap will be in proportion to the roll gap change ordinates given by curve 2′. Curve 3′ shows how a reverse taper is made, while still maintaining the same position relationships.

Thus the required rotations of the four wormwheels to produce a tapered roll gap are in the ratio 3:1:- 1:-3 in the case of a mill having four saddles.

Figure 3:
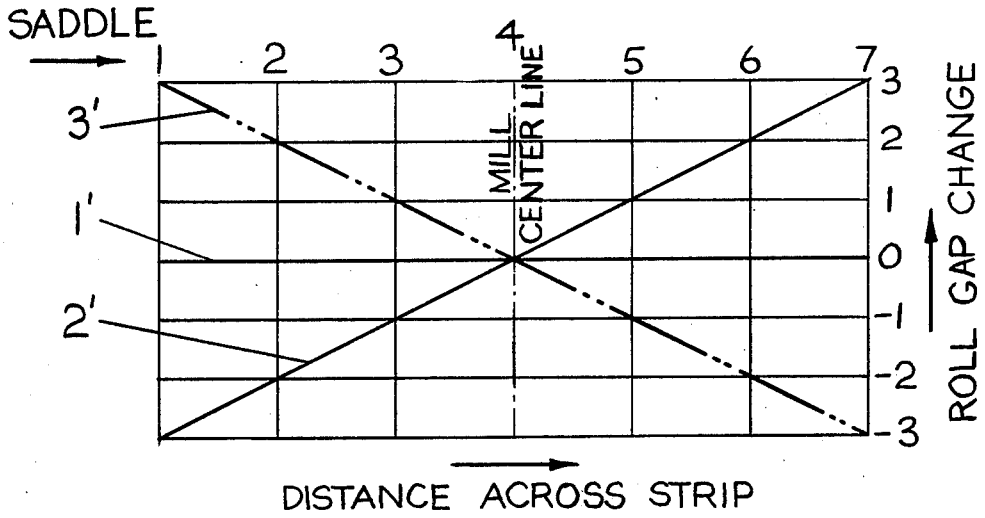
FIG. 3 is a diagram similar to FIG. 2 but for a mill having seven saddles on each backing shaft.

FIG. 3 is a curve similar to FIG. 2, but for a mill having seven saddles. It can be seen that in this case the required rotations of the seven wormwheels would be in the ratio 3:2:1:0:-1:-2:-3.

Figure 4:
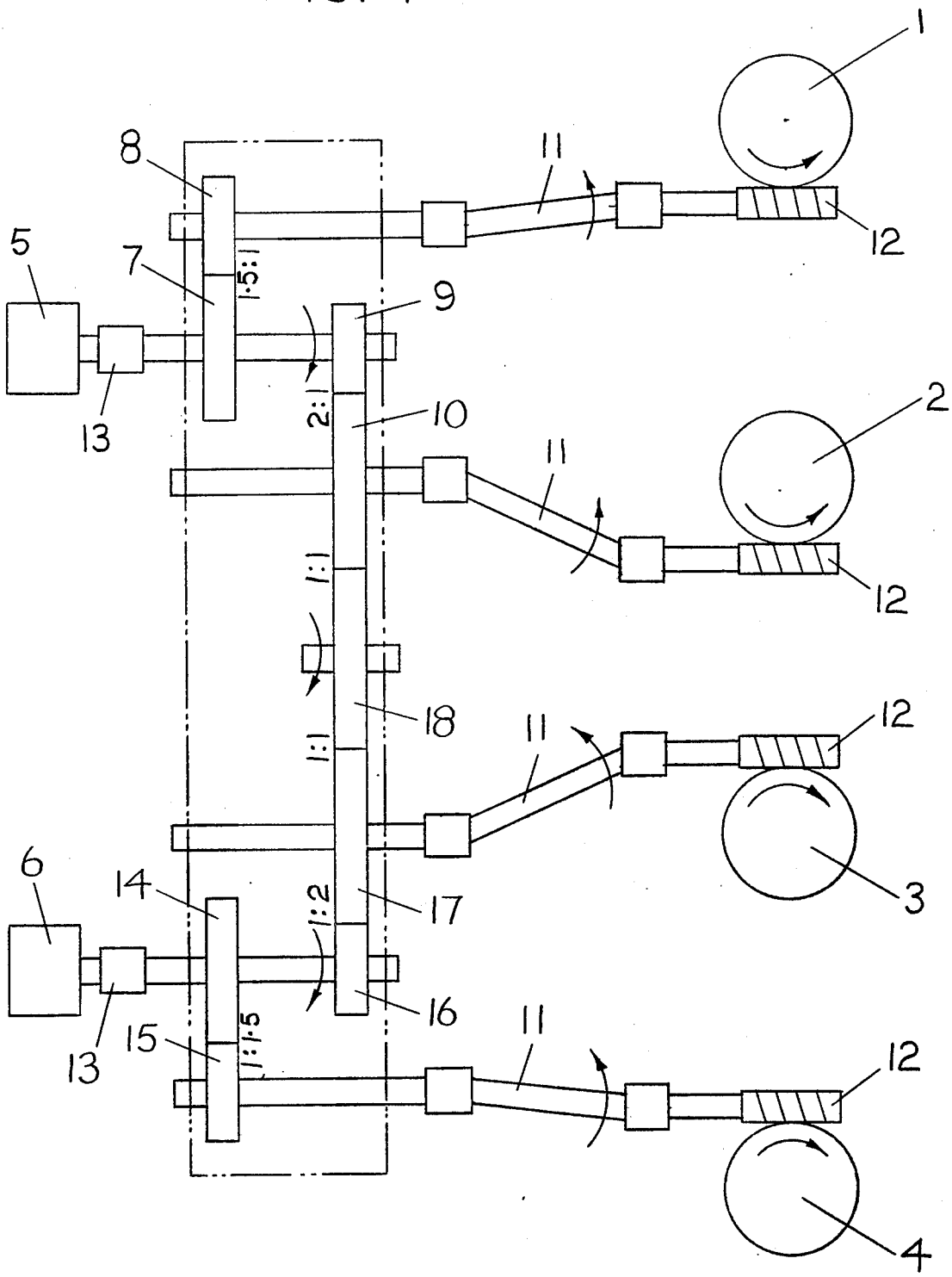
FIG. 4 is a diagrammatic plan view of a taper drive system according to the present invention.

In FIG. 4 one embodiment of the invention is diagrammed for a mill having four saddles on each backing shaft, in which the required rotations of the wormwheels are in the ratio 3:1:-1:-3. In this Figure taper drive motor 5 drives gears 7 and 9 via a coupling 13. Gear 7 transmits the drive with a speed increase of 1.5:1 via gear 8, a spindle 11 and a worm 12 to wormwheel 1. Gear 9 transmits the drive with a speed reduction of 1:2 via gear 10, a spindle 11 and a worm 12 to wormwheel 2. Taper drive motor 6 drives gears 14 and 16 via a coupling 13. Gear 14 transmits the drive with a speed increase of 1.5:1 via gear 15, a spindle 11 and a worm 12 to wormwheel 4. Gear 16 transmits the drive with a speed reduction of 1:2 via gear 17, a spindle 11 and a worm 12 to wormwheel 3.

Idler gear 18 is used to synchronize taper drive motors 5 and 6 so that they both rotate at the same speed in the same direction In an alternative embodiment one of the taper drive motors may be omitted as its only function is to assist the other drive motor.

The arrows on FIG. 4 mark the direction of rotation of all components and it can be seen that the required ratio of rotations of the output wormwheels is achieved with this design provided gear ratios as specified on FIG. 4 are used.

Figure 5:
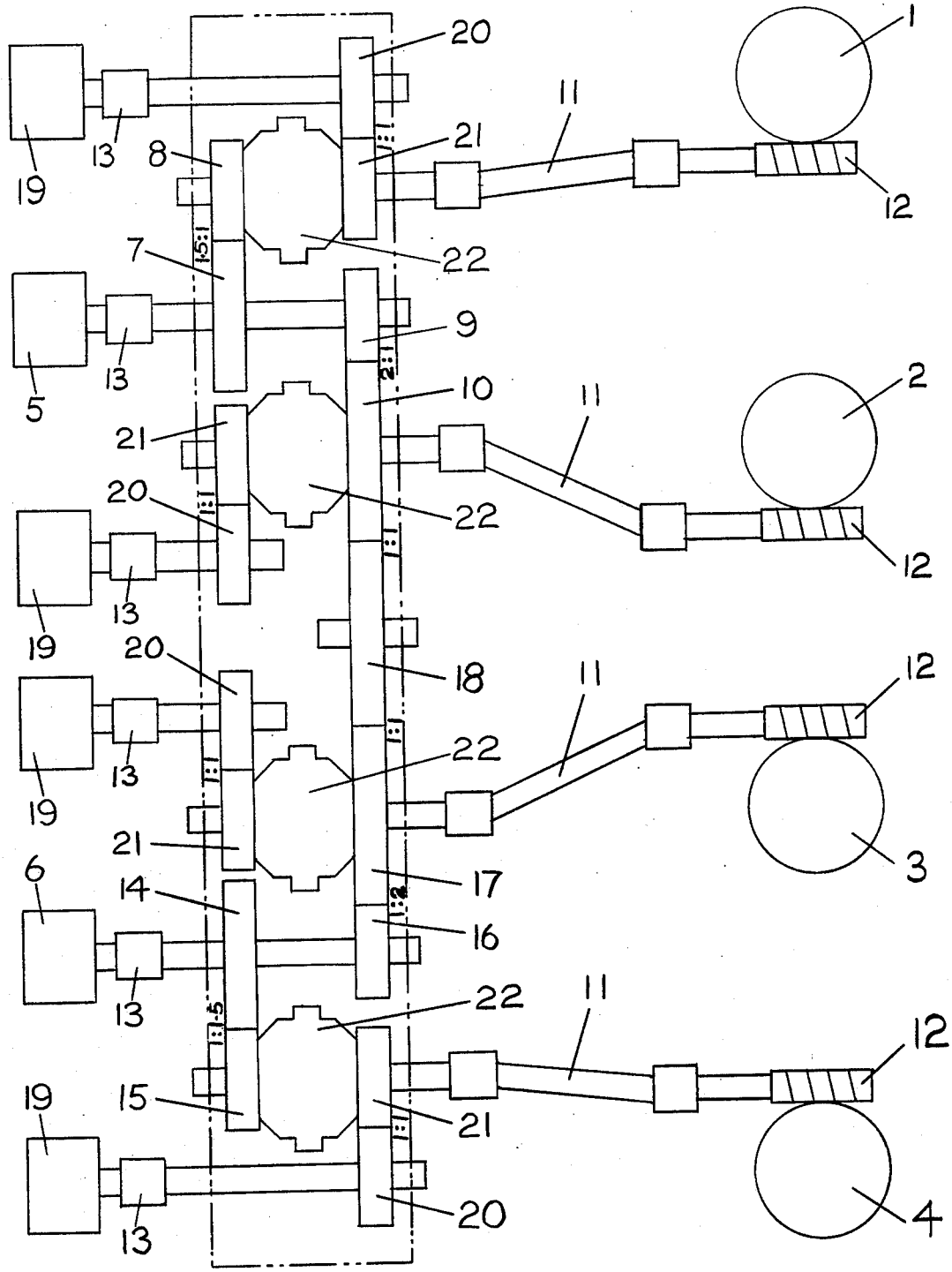
FIG. 5 is a diagrammatic plan view of a combined taper/crown drive system according to the present invention.

Another embodiment of the invention, for a mill having four saddles on each backing shaft, is shown in FIG. 5. In this embodiment the combination of independent adjustment of each wormwheel (for crown control) and synchronized taper drive adjustment is achieved.

In FIG. 5, four independent crown adjustment drive motors 19 each drive one wormwheel (1, 2, 3 or 4) via a coupling 13, algebraic gears 20 and 21, a differential 22, a shaft 11 and a worm 12. Each differential has two inputs, (driving the two side bevel gears) one input being the crown adjustment input gear 21, and the other input being the crown adjustment input gear 21, and the other input being the taper drive input gear described in connection with FIG. 4 (8, 10, 15, or 17). The output shaft of each differential is driven by the differential cage and rotates at a speed equal to the lagebraic sum of the speeds of the two inputs; it is directly coupled to a spindle 11 which drives an output wormwheel (1, 2, 3 or 4) via a worm 12.

When all four crown adjustment drive motors 19 are stationary, taper drive motor 5 drives wormwheel 1 via gears 7 and 8, a differential 22, a spindle 11 and a worm 12. It also drives wormwheel 2 via gears 9 and 10, a differential 22, a spindle 11 and a worm 12. Taper drive motor 6 drives wormwheel 4 via gears 14 and 15, a differential 22, a spindle 11 and a worm 12. It also drives wormwheel 3 via gears 16 and 17, a differential 22, a spindle 11 and a worm 12. Taper drive motors 5 and 6 are synchronized by idler gear 18 which meshes with gears 10 and 17. It can be seen that these rotations of taper drive motors 5 and 6 cause rotation of wormwheels 1, 2, 3, and 4 at relative speeds of 3, 1, −1 and −3 respectively, thus achieving the required speed ratio between these wormwheels, provided gear ratios as specified on FIG. 5 are used.

When taper drive motors 5 and 6 are stationary, it can be seen that the four crown adjustment drive motors 19 can be driven independently, and each motor will cause independent rotation of its corresponding wormwheel.

Figure 6:
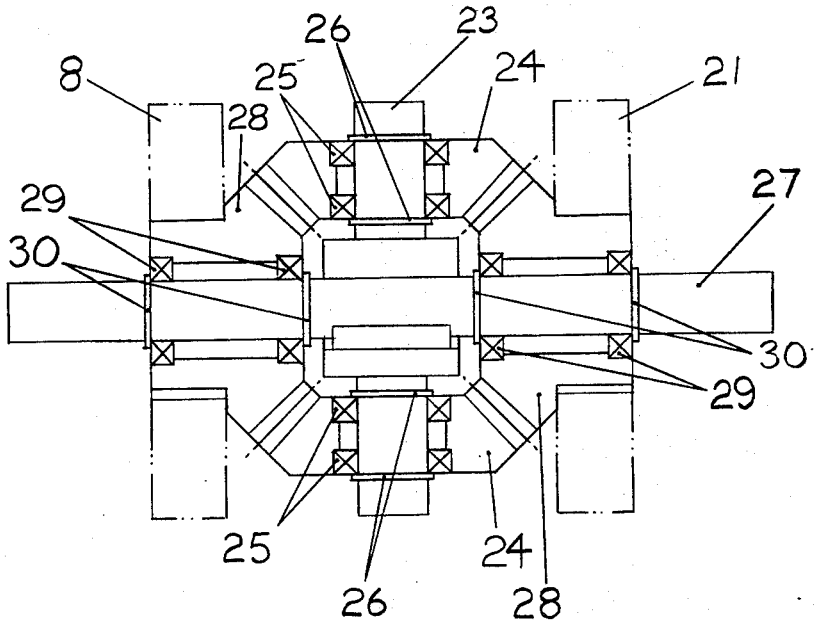
FIG. 6 is a diagrammatic cross sectional view showing the detailed construction of one of the differential units shown in FIG. 5.

FIG. 6 illustrates the construction of the aforesaid differentials. This construction is typical of commercially available differential units. A cage 23 has two cage bevel pinions 24 rotatably mounted on ball bearings 25 located by snap rings 26. The cage is keyed to drive shaft 27. Two side bevel gears 28 are each rotatably mounted on shaft 27 by means of ball bearings 29 located by snap rings 30. The side bevel gears are provided with cylindrical surfaces on which input drive gears, 3, 5, 8, 21, (shown in phantom) can be mounted and keyed. The side bevel gears mesh with the cage bevel gears.

The embodiments described above are given as examples only and are intended in no way to limit the scope of the invention.

Clearly the invention can be applied to Sendzimir cluster mills having any number of supports (saddles) on each backing shaft. Note that in the case of mills having an odd number of saddles, the middle saddle lies on the mill center line and in general, it will not be driven by the taper drive system, since its required movement under taper drive is zero at all times.

In FIGS. 2 and 3 the required position relationships are shown with a zero point at the mill center line. Clearly the zero point could have been taken at any other point across the mill, for example at saddle No. 1, and the synchronizing gear ratios adjusted accordingly. In such a case, an advantage would be obtained because all the wormwheels would be driven in the same direction during a synchronized adjustment, so the accuracy of the synchronization would be degraded minimally by the backlash between worms and wormwheels. However, the range of adjustment obtainable would be halved in this case, as the number of revolutions of each wormwheel for the full range of adjustment is fixed.

Figure 7:
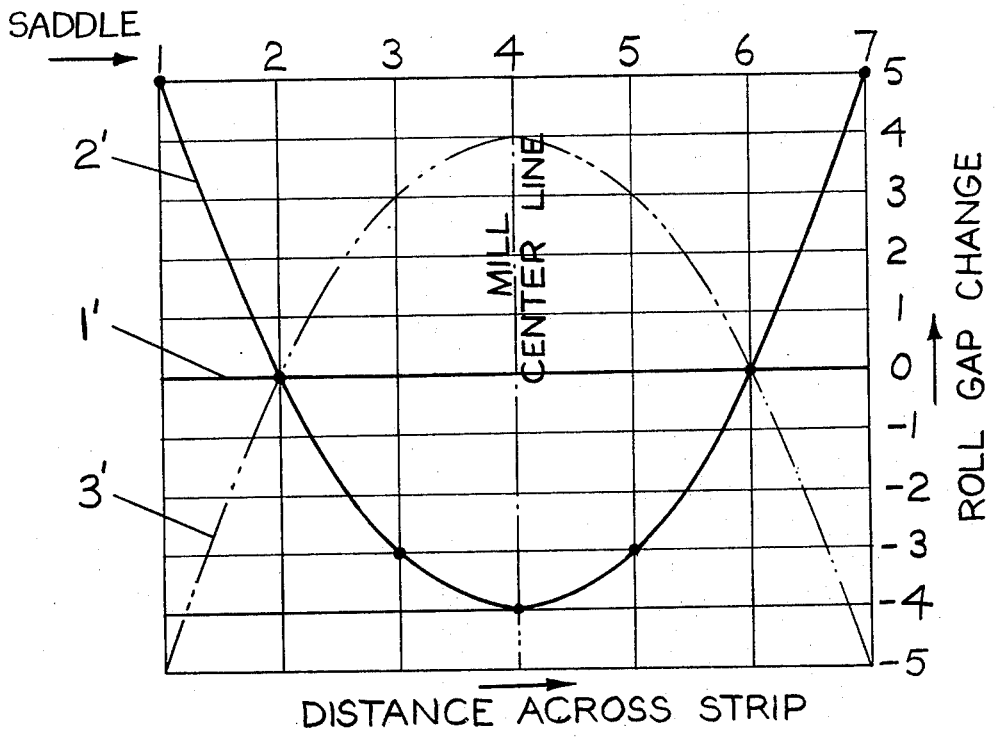
FIG. 7 is a diagram similar to FIG. 3, but showing required position relationships to achieve a parabolic roll gap instead of a tapered roll gap.

For the case of wide cluster mills, or any cluster mills which roll strip which has not been slit after its rolling on a hot mill, such synchronization means can be used to set, for example, a parabolic form of the roll gap, or a form to suit the profile of the incoming strip, the tapered form of roll gap clearly not being required in this case. For wide cluster mills, the mechanical and thermal crown of the mill itself can have a significant effect, so it is also possible to use such sychronization to produce a form of roll gap which will be a mirror image of the mill crown, thus nullifying the bad effect of the mill crown upon the shape or flatness of the rolled strip. FIG. 7 shows typical required position relationships for each crown adjusting drive for a parabolic roll gap on a mill having seven saddles on each backing shaft. The full line curve 2′ and phantom curve 3′ show the two extremes of the range of synchronized parabolic rool gap adjustment with settings possible anywhere with this range. Mid-range is curve 1′ which gives a uniform roll gap.

The effect of having an incorrect taper set into the roll gap when rolling strip having a transverse taper in thickness so called "wedge shaped" strip —can be very serious. The immediate effect is that one edge of the strip receives a greater elongation than the other with the result that the rolled strip tends to move laterally toward the edge having the lower elongation, and the tension in the edge having the lower elongation becomes higher than the tension in the other edge. In serious cases succeeding laps of strip on the coiler are offset from each other, thus forming a "telescoped" coil which may be extremely difficult to handle and would probably be scrapped. Either strip edge position detectors or differential tensiometers (the latter consisting of a load measuring device under each bearing of a deflector roll which the rolled strip passes over, and a device for comparing the load on each bearing and hence the relative tension on each edge of the strip) can be used to detect this effect, and automatic means such as electronic amplifiers and electrohydraulic servovalves or relays and solenoid valves can be used to amplify the strip position error, or differential tension error to provide a correction signal to the taper drive motors in order to bring the strip back to its correct path and so to balance the tensions in front and back edges of the strip. Preferably the taper drive motors are hydraulic motors and proportional control is achieved by using an electrohydraulic servovalve to supply oil to these motors (which will be hydraulically connected in parallel if more than one motor is used). It is also possible to use on-off control by using a solenoid valve to supply oil to these motors, since the required speed of response of the system is not very high.

Figure 8:
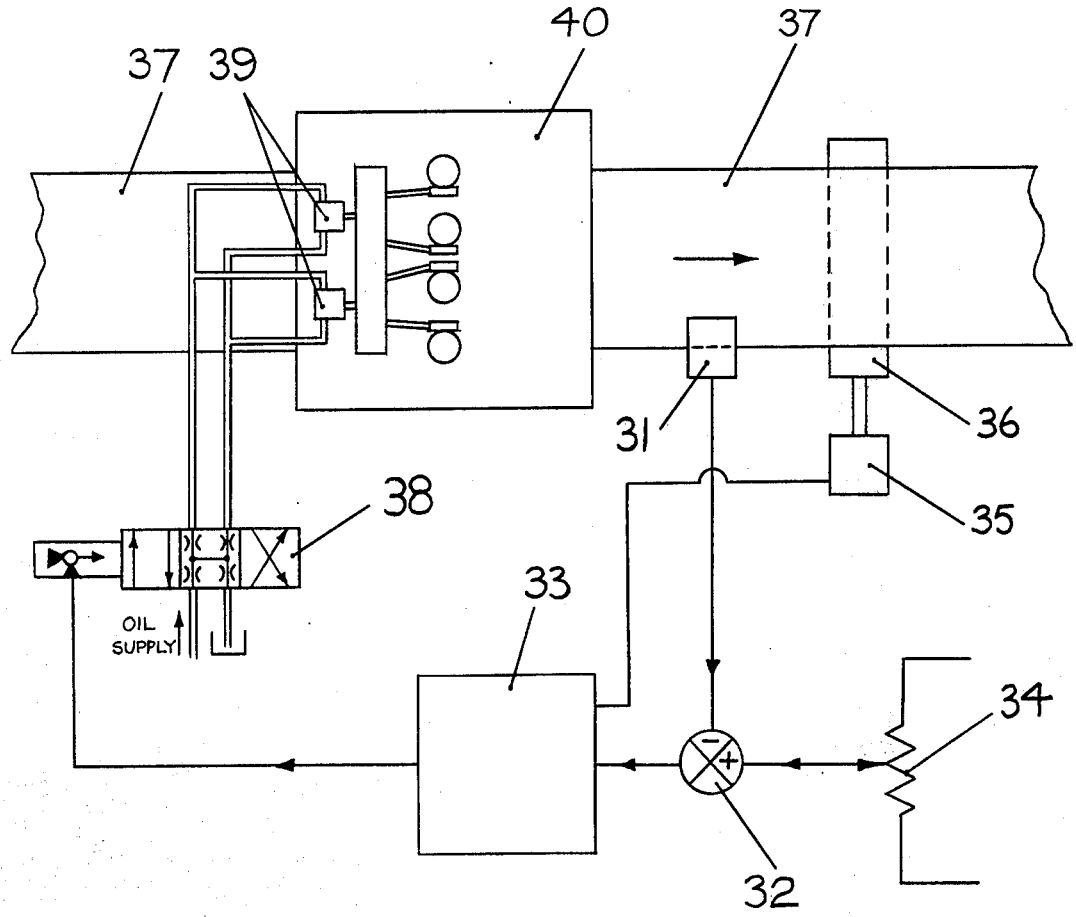
FIG. 8 is a schematic showing of an automatic control system to operate the taper drive in response to the behavior of the rolled strip.

A schematic diagram of a typical closed loop automatic control system to maintain equal elongation in front and back edges of strip is shown in FIG. 8. A photo-electric sensor 31 is used to detect the strip edge position. The electrical analog signal produced by this sensor is compared with the required or reference position signal (set by operator using potentiometer 34) by comparator 32 which gives an output signal equal to the difference between reference and measured position and which therefore represents strip edge position error. This error signal is amplified and suitably delayed using controller 33, the necessary delay to achieve system stability varying with strip speed, an electrical analog signal of which is supplied to the controller from tacho-generator 35 (driven by deflector roll 36). Deflector roll 36 is driven by strip 37 as it emerges from the mill 40 (shown in plan view) and passes around the deflector roll under tension. The output signal from the controller is used to energize the coil of servovalve 38, which supplies hydraulic oil under pressure to drive taper drive motors 39 in such a direction as to correct the error.

The embodiments of the invention in which an exclusive property or privilege is claimed are defined as follows:

1. In a cluster mill having individual drives on at least one of the backing shafts, to adjust the roll gap in line with each saddle, means for mechanically synchronizing the drives such that they act together to form a roll gap which tapers down from front to back of the mill when operated in one direction, and which tapers down from back to front when operated in the other direction, the magnitude of the taper being proportional to the synchronized movement of the drives away from their neutral position of which the roll gap is parallel, together with mechanical means to allow individual adjustment of the roll gap in line with each saddle, independently of the synchronzied adjustment.

2. In a cluster mill with means according to claim 1, and equipped with measuring devices to measure the tension difference between front and back edges of the strip, automatic control means to operate the synchronized drives to increase or decrease the taper of the roll gap in order to minimize tension difference between front and back edges of strip.

3. In a cluster mill with means according to claim 1, and equipped with measuring devices to measure any lateral movement of the strip as it passes through the mill, automatic control means to operate the synchronized drives to correct any lateral movement of the strip.

4. In a cluster mill having a number of worm-wheel driven saddles on at least one of the backing shafts, to adjust the roll gap in line with each saddle, a drive system for said worm-wheels including a synchronized drive means consisting of selected gear ratios in the drive train to each worm-wheel on one side of the mill, and like selected gear ratios but in the opposite direction in the drive trains to each worm-wheel on the other side of the mill, whereby synchronously to move said saddles away from their positions in which the roll gap is parallel, to positions in which a tapered roll gap is created, and also including an independent drive means for each worm-wheel and a differential in each drive train, said synchronized drive means constituting one input to the respective differentials and said independent drive means providing another input to the respective differentials, the outputs of the several differentials driving said worm-wheels at speeds representing an algebraic sum of the speeds of said independent drive means and said synchronized drive means.

5. In a cluster mill having individual drives on at least one of the backing shafts, to adjust the roll gap in line with each saddle, means for mechanically synchronizing the drives such that they act together to form a symmetrical roll gap profile which will be convex when they are operated in one direction, and concave when they are operated in the other direction, the mathematical form of the profile depending on the gear ratios selected, and the magnitude of the convexity or concavity being proportional to the synchronized movement of the drives away from their neutral position for which the roll gap is parallel, together with mechanical means to allow individual adjustment of the roll gap in line with each saddle, independently of the synchronized means.

* * * * *